United States Patent [19]

Panaro

[11] 4,216,457

[45] Aug. 5, 1980

[54] ELECTRIC FUSE HAVING FOLDED FUSIBLE ELEMENT AND HEAT DAMS

[75] Inventor: Robert J. Panaro, Byfield, Mass.

[73] Assignee: Gould Inc., Rolling Meadows, Ill.

[21] Appl. No.: 932,020

[22] Filed: Aug. 8, 1978

[51] Int. Cl.[2] ..... H01H 85/04

[52] U.S. Cl. ..... 337/160; 337/159; 337/296

[58] Field of Search ..... 337/161, 162, 160, 159, 337/158, 290, 292, 295, 296, 293

[56] References Cited

U.S. PATENT DOCUMENTS

| | | | |
|---|---|---|---|
| 3,189,712 | 6/1965 | Kozacka | 337/161 |
| 3,261,950 | 7/1966 | Kozacka | 337/161 |
| 3,935,553 | 1/1976 | Kozacka et al. | 337/159 |

*Primary Examiner*—Harold Broome
*Attorney, Agent, or Firm*—Erwin Salzer

[57] ABSTRACT

A fusible element for electric fuses capable of combining time-lag in the range of overload currents with current-limiting action for currents in the range of short-circuit currents. The fusible element comprises a relatively wide perforated center section and axially outer heat dam sections. The center section has points of reduced cross-section imparting to it a predetermined fusing $i^2 \cdot t$. The center section of the fusible element is folded in a direction longitudinally thereof to effect mutual heating of the portion, or portions, thereof to different sides of the fold, or folds. This allows to increase the mass of the center section and results in an increase of time-lag. Relatively narrow heat-dam-strip sections extend from the ends of said center section. The fusing $i^2 \cdot t$ of the heat-dam-strip sections is larger than that of the center section to avoid fusion of the heat-dam-strip sections prior to that of the center section, or to entirely preclude fusion of said heat-dam-strip sections. The heat-dam-strip sections are folded in transverse direction which increases their length for given casing dimensions and consequently their resistance to axially outward heat flow from the center section, thereby enhancing the same effect that results from the reduced width of the heat-dam-strip sections relative to the width of the center section.

The points of reduced cross-section of the center section are of a metal having a low fusing $i^2 \cdot t$, in particular silver, to minimize its fusing $i^2 \cdot t$. The heat dam sections are of a metal other than silver in the interest of greater economy and greater flexibility. Electroconductive bonds connect the center section to the heat-dam-strip sections.

13 Claims, 10 Drawing Figures

ELECTRIC FUSE HAVING FOLDED FUSIBLE ELEMENT AND HEAT DAMS

BACKGROUND OF THE INVENTION

The principal object of the present invention is to provide an improved fusible element for an electric time-lag motor starter fuse having a voltage rating up to 600 volts and also capable of current-limiting action.

U.S. Pat. No. 3,935,553; 01/27/76 to Frederick J. Kozacka et al, CARTRIDGE FUSE FOR D-C CIRCUITS describes a time-lag fuse having a fusible element capable of meeting the above requirements; but which is difficult and expensive to manufacture.

It is, therefore, another object of this invention to provide an improved version of the fusible element and of the fuse described in the above patent.

The family of patents recited below is of interest in connection with the present invention. Each of them describes a fuse comprising a fusible element having a perforated center portion having an M-effect overlay, and non-perforated end or heat dam portions of smaller cross-section than the center portion and connecting the center portion and the terminal elements, or terminal caps, of the fuse.

U.S. Pat. No. 3,261,950; 07/19/66 to F. J. Kozacka for TIME-LAG FUSES HAVING HIGH THERMAL EFFICIENCY; U.S. Pat. No. 3,261,952; 07/19/66 to F. J. Kozacka for TIME-LAG FUSE WITH RIBBON FUSE LINK HAVING TWO SYSTEMS OF BENDS; U.S. Pat. No. 3,291,943; 12/13/66 to F. J. Kozacka for TIME LAG FUSE WITH RIBBON FUSE LINK FOLDED IN LONGITUDINAL AND IN TRANSVERSE DIRECTION; U.S. Pat. No. 3,319,028; 05/09/67 to F. J. Kozacka for SPRINGLESS TIME LAG FUSE FOR MOTOR CIRCUITS; U.S. Pat. No. 3,341,674; 09/12/67 to P. C. Jacobs, Jr. for ELECTRIC QUARTZ-SAND-FILLED FUSE ADAPTED TO INTERRUPT EFFECTIVELY PROTRACTED SMALL OVERLOAD CURRENTS; and U.S. Pat. No. 3,382,335; 05/07/68 to F. J. Kazacka for ELECTRIC FUSE HAVING PRISMATIC CASING.

The points of reduced cross-section of a fusible element for a current-limiting fuse should be of silver to minimize the fusing $i^2 \cdot t$ thereof. There is no such requirement in regard to the heat dam portions of the fusible element. It is, therefore, another object to provide fusible elements whose points of arc initiation are of silver, but whose heat dams are of a less expensive metal other than silver.

Great difficulties arise when blanking or stamping the center portion and the heat dam portions out of a piece of metal and folding the center portion and the heat dam portions in opposite directions, as required by the above prior art patents. In particular, when folding the heat dam sections in transverse direction, as required, both ends of the heat dam sections tend to move in a direction longitudinally thereof, but are only allowed at their axially outer ends to do so while their axially inner ends are fixed by the perforated center section or center portion of the fusible element.

It is, therefore, a further object of the invention to greatly facilitate the manufacture of fusible elements including a relatively wide perforated center section folded in a direction longitudinally thereof and relatively narrow heat dam sections folded in a transverse direction.

Other objects of the invention will become more apparent as this specification proceeds.

SUMMARY OF THE INVENTION

Fusible elements embodying this invention comprise the following parts: Relatively wide center sections folded in a longitudinal direction, a pair of relatively narrow heat dam sections folded in transverse direction, and electroconductive bonds connecting the axially outer ends of the center sections to the heat dam sections.

The center sections are perforated and define a plurality of points of reduced cross-section. Said points of reduced cross-section consist of a first metal having a relatively small fusing $i^2 \cdot t$, and said points of reduced cross-section having a predetermined fusing $i^2 \cdot t$.

The pair of heat dam sections each consist of a second metal having a relatively large fusing $i^2 \cdot t$. The heat dam sections further have a fusing $i^2 \cdot t$ which is larger than said predetermined fusing $i^2 \cdot t$ of said center section to prevent fusion thereof by the flow of an electric current prior to fusion of the center section.

The aforementioned first metal is preferably silver, and the aforementioned second metal is preferably copper or bronze.

DESCRIPTION OF PREFERRED EMBODIMENTS

Figures 1, 2, 3, 4, 5, 6:
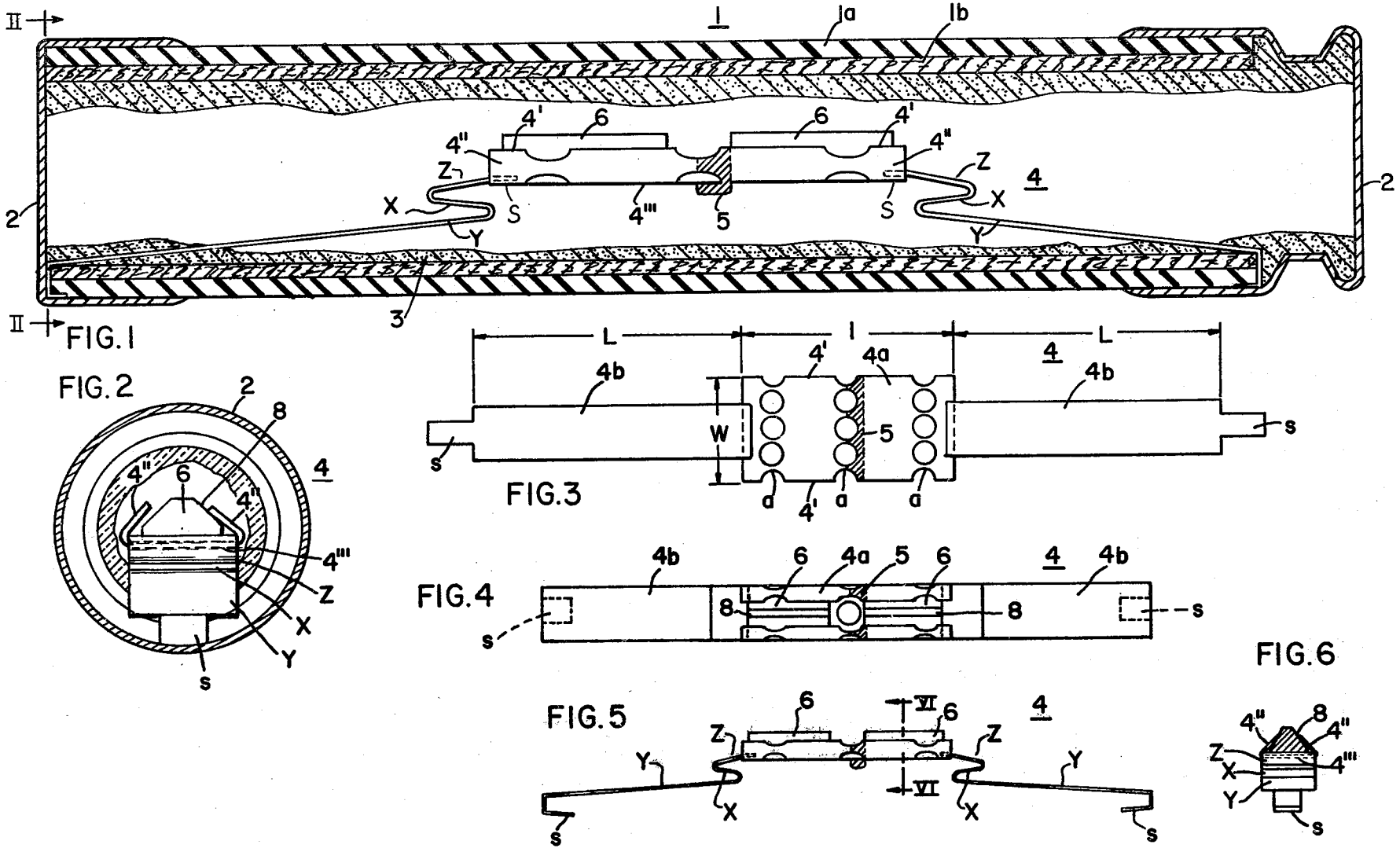
FIG. 1 is partly a longitudinal section and partly an elevation of a fuse embodying this invention drawn at a larger scale than 1:1.
FIG. 2 is a section of the structure of FIG. 1 taken along II—II of FIG. 1.
FIG. 3 is a top-plan view of the fusible element for the structure of FIG. 1.
FIG. 4 shows a top-plan view of the structure of FIG. 1 wrapped around two rods of gas-evolving material.
FIG. 5 shows the structure of FIG. 4 in side elevation.
FIG. 6 is a section along VI—VI of FIG. 5.

In the drawings reference numeral 1 has been applied to indicate a tubular casing of electric insulating material. The casing 1 may include one or more than one ply of glass cloth and synthetic resin. By way of example a multiple casing has been shown including several plies of glass cloth and synthetic resin designated by reference numeral 1*a* and an inner liner 1*b* of asbestos enclosed between sheets of a plastic material. The thermal insulating liner 1*b* becomes necessary if the thermal conductivity of the outer glass cloth synthetic resin laminate layers is too large. In other instances the liner 1*b* may be omitted. To provide liner 1*b* becomes generally necessary if the outer plies of glass fiber and synthetic resin include polyester. A pair of terminal caps 2 is arranged at the ends of casing 1 and closes the ends thereof. An arc-extinguisher pulverulent or granular filler 3, preferably quartz sand, is arranged inside of casing 1. Filler 3 has only been indicated adjacent the interface with casing 1, but actually fills the entire volume of casing 1, except where other parts within casing 1 are located. Numeral 4 has been applied to generally indicate a fusible element or fuse link conductively interconnecting terminal caps 2. Fuse link 4 includes the center section 4*a* and the heat dam sections 4*b*. Center section 4*a* includes a plurality of longitudinal lines of perforations defining three serially arranged points of reduced cross-section and a plurality of transverse lines of perforations defining points of reduced cross-section a which are connected in parallel.

Link-severing low fusing point overlay, or a so-called M-effect overlay 5 extends across the center section 4*a*. Overlay 5 has substantially the same length as the width W of center secton 4*a*. The center section 4*a* may consist of sheet silver, but at least its points of reduced cross-section a must consist of sheet silver to minimize the fusing $i^2 \cdot t$ thereof. Its overlay 5 may be of tin, or of tin alloys. A pair of rods 6 of a gas-evolving material, i.e. of a material evolving arc-extinguishing or de-ionizing gases under the heat of electric arcs is arranged to opposite sides of overlay 5. Rods 6 have a periphery which is less than the width W of center section 4*a* and are affixed to center secton 4*a* by wrapping the latter around rods 6. A gap 8 is left between the two longitudinal edges 4' of center section 4*a* beyond which rods 6 extend in upward direction. It will be apparent from the above that center section 4*a* is folded or wrapped around rods 6 to form a channel, or a channel-shaped conductor having a flange 4'' and a web portion 4'''. The gap between rods 6 is not only important in regard to the rating of the fuse but also to allow initial rapid burnback at low blowing current intensities. The two non-perforated heat dam sections 4*b* of fusible element 4 extend in opposite directions from the web portion 4''' to terminal caps 2. The length L of each of the heat dam sections 4*b* exceeds the length 1 of the center section 4*a* and the width of heat dam sections 4*b* is less than the width of center section 4*a* and about equal to that of web 4'''. The resistance of heat dam portions 4*b* is far less than the resistance of center section 4*a* on account of the perforations in said center section and the shorter length of the latter. Each of the pair of heat dam sections 4*b* includes a first portion x that is positioned axially outwardly from web portions 4''' and a second portion y that extends axially outwardly from said first portion toward one of the terminal caps 2. The length of said second portion y by far exceeds the length of said first portion x and is substantially equal to the length of said center section 4*a*.

The heat dam portions x,y proper are connected by an additional portion z of equal width as said heat dam portions x,y to center section 4*a*. Portions z extend axially outwardly from web 4''' and have the substantially same width as web 4''' and are interposed between web 4''' and first section x. Portions z are inserted at s into the axially outer ends of channel-shaped center portion 4*a* and bonded to web portion 4''', preferably by spot welding. Heat dam sections 4*b* and web portion 4''' overlap which tends to increase the heat-absorbing capacity and hence the time-lag of the fusible element. The axially outer ends of heat dam sections 4*b* are bent as indicated at s to engage casing 1*a* and liner 1*b*.

At relatively low currents, e.g. two times the rated current of the fuse, the overlay 5 melts and this initiates a metallurgical reaction, as a result of which the fusible element is severed approximately at the center of the center section 4*a* of the fusible element 4 thereof. When the current is increased, the point of arc initiation shifts to one of the axially outer lines of perforations, a phenomenon well known in the fuse art. It is due to the fact that the energy needed for melting the fusible element at one of the axially outer lines of perforations plus thermal losses occuring during the melting time are less than the energy required for severing the fusible element by a metallurgical reaction at overlay 5 plus the thermal losses occurring during the time required to sever fusible element 4. The losses occurring during the time required to sever the center section 4*a* of fusible element 4 at overlay 5 are large because the time required to sever the fusible element by a metallurgical reaction is quite long. The fact that arc initiation occurs but at one of the axially outer lines of perforations is attributed to the tolerances between the two axially outer lines of perforations and the fact that the current is finally interrupted before an arc is initiated at the points of reduced cross-sections a of the second line of perforations. Arc inception occurs but at one line of perforations—either the axially outer line on the right or the axially outer line on the left—at overloads in the range of about 9 times the rated current of the fuse. At loads of this order the burnback of the fusible element to one side of the point of break may extend to the perforations of the center section of the fusible element on the other side of the fusible element, and at the same time portions z,x and y of the fusible element adjacent the point of arc initiation may be consumed by the arc. If the fault current is greatly increased, e.g. to 10 kA, series breaks are formed almost simultaneously at the three lines of reduced cross-section in the center section 4*a* of the fusible element 4, and arcing may extend to portions z and x of heat dams 4*b* and slightly affect the axially inner ends of portions y thereon. The same is true if the fault current is increased, to say 20 kA.

A casing of a laminate of glass cloth and melamine has the right thermal characteristics or heat dissipating characteristics of a fuse embodying this invention. A casing of a laminate of glass fibers and polyester as described in U.S. Pat. No. 3,979,709; Sept. 7, 1976 to D. P. Healey, Jr. for ELECTRIC FUSE HAVING A MULTIPLY CASING OF A SYNTHETIC-RESIN GLASS CLOTH LAMINATE dissipates too much heat and must, therefore, as mentioned above, be provided with a liner or shield 1*b* to impart to it the required thermal characteristics. In order to achieve a high interrupting capacity the arc-quenching filler 3 should preferably be quartz sand whose thermal characteristics vary within narrow limits. However, the thermal characteristics of quartz sand may be affected by additives which generally decrease the thermal conductivity of quartz sand. These are variations that must be taken into account when designing a fuse according to the present invention.

Figure 7:
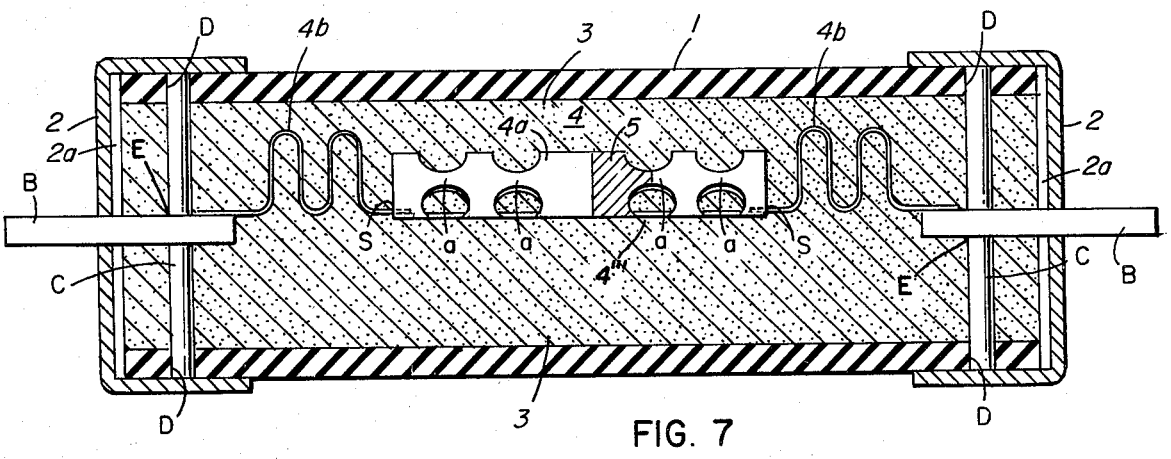
FIG. 7 is partly a longitudinal section and partly an elevational view of another fuse embodying the invention.
Figure 8:
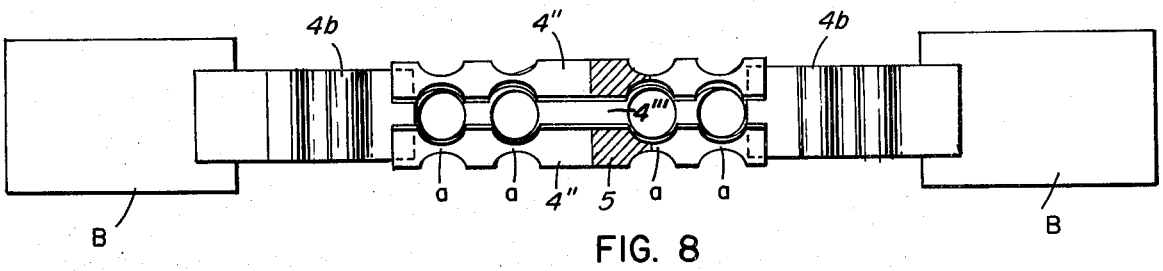
FIG. 8 is a top plan view of the fusible element of the structure of FIG. 7.

Referring now to FIGS. 7 and 8, the same reference characters as in FIGS. 1–6 have been applied to indicate like parts. Casing 1 is made of a conventional casing material requiring no liner. Its ends are closed by a pair of terminal caps or ferrules 2 and washers 2*a* are interposed between the rims of casing 1 and caps or ferrules 2. A pulverulent arc-quenching filler is arranged inside of casing 1. A pair of blade contacts B projects from the outside of casing 1 through caps or ferrules 2 and washers 2*a* into the inside thereof, and are fixedly positioned by a pair of pins C. Pins C project through bores D in casing 1 and bores E in blade contacts B. The fusible element 4 comprises a relatively wide fusible section 4a having a plurality of points of reduced cross-section a of sheet silver. These points of reduced cross-section a must be of sheet silver to minimize the melting $i^2 \cdot t$ of the fusible element 4, but the entire fusible element must not necessarily be of sheet silver. In the embodiment of the invention shown in FIGS. 7 and 8 the relatively wide center section 4a of the fusible element 4 is made of silver and has four serial lines of circular perforations of which each line defines a plurality of points a of reduced cross-section. Reference numeral 5 has been applied to indicate an overlay of a low fusing point metal, such as tin, capable of severing by a metallurgical reaction the base metal, i.e. silver, by fusion of the overlay metal. The relatively wide section 4a is folded in a direction longitudinally thereof. It may be folded but once, as shown in U.S. Pat. No. 3,291,943 referred-to above, but in the embodiment shown in FIGS. 7 and 8 it has been folded twice in a direction longitudinally thereof to assume substantially the shape of a channel having a web portion 4''' and two flange portions 4''. Reference numeral 4b has been applied to indicate a pair of relatively narrow metal strips which may be referred-to as heat-dam-strip sections because of their function to retain the heat in center section 4a of the fusible element 4. Heat-dam-strip sections 4b have a melting $i^2 \cdot t$ value which is larger than the melting $i^2 \cdot t$ value of the center section or perforated section 4a so that arc-initiation must occur at said center section or perforated section and cannot occur at the heat-dam-strip sections 4b. Heat-dam-strip sections 4b are folded in transverse direction to limit the axial extent of the length thereof, i.e. to be able to impart a length to heat-dam-strip sections 4b which exceeds considerably the distance between the axial ends of center section or perforated section 4a and terminal caps 2. Heat-dam-strips consist of a metal other than silver, e.g. copper, or bronze. Electroconductive bonds to which reference numeral S has been applied conductively connect the axially outer ends of center section 4a to the axially inner ends of sections 4b of heat-dam-strips. In the embodiment shown in FIGS. 7 and 8 the web portion 4''' of the channel-shaped center portion 4a is spot welded to the heat-dam-strip sections 4b in overlapping relation. The heat-dam-strip sections 4b need, however, not be conductively connected to the web portion but may be conductively connected, or spot-welded, to the flange portions 4'' of channel-shaped center portion. A geometry of this kind is shown in U.S. Pat. No. 3,341,674 to P. C. Jacobs, Jr., 09/12/67 for ELECTRIC QUARTZ SAND FILLED FUSE ADAPTED TO INTERRUPT EFFECTIVELY OVERLOAD CURRENTS, except that in the above patent the center section of the fusible element and ist heat-dam-strip sections are made of one piece and are of the same metal. As shown in FIGS. 7 and 8 the heat-dam-strip sections 4b overlap the web portion 4''' of center section 4a. To be more specific, the heat-dam-strip sections are inserted into the space defined by said web portion 4''' and said flange portions 4'' of said center section 4a so that there is an overlap between said web portion 4''' and said heat-dam-strip sections 4b, and said web portion 4''' is welded to said heat-dam-strip sections 4b.

As mentioned above, the object of heat-dam-strip sections 4b is to minimize axially outward heat flow from center section 4a, but—theoretically speaking—there is no need to generate heat by $i^2 \cdot r$ losses in sections 4b. In other words, sections 4b should have a low rate at which heat travels through a unit length of the metal of which sections 4b are made for a unit temperature gradient, or have a low thermal conductivity. The metal of which sections 4b are made should at the same time have a high ability to conduct electricity, or have a high electrical conductivity. Good thermal conductors are generally good conductors of electricity and vice versa, bad thermal conductors are generally bad conductors of electricity. It is not possible to have bad thermal conductivity and good electric conductivity at the same time or for the same conductor. The reason for this is known as the Wiedermann-Franz-Lorenz law.

The Wiedermann-Franz-Lorenz law is to the effect that the ratio of the thermal and electrical conductivities at a given temperature is independent of the conductor material. The heat dams 4b are supposed to keep in the heat at, i.e. to thermally insulate, the fusible element section, or the center section 4a, of the fusible element 4, and hence be made of a metal having a relatively small thermal conductivity. On the other hand, the heat dams 4b are supposed to generate as little heat as possible by $i^2 \cdot r$ losses, and hence their electrical conductivity should be large. The Wiedermann-Franz-Lorenz law may be written as follows $$C=(K/T)\cdot T$$

Wherein C is a material constant, K the thermal conductivity, X the electrical conductivity, and T the absolute temperature. For copper at 20° C. the constant C=5.45. Heat dam sections 4b of copper have proven to be quite satisfactory. Alloys of copper have proven even more satisfactory in certain instances. This is mainly due to the fact that metals having a higher resistivity than copper require larger dimensions, in particular larger cross-sections, than copper and, therefore, a higher dimensional stability may be imparted to heat dam sections 4b of bronze and other metals or alloys. If the perforated section 4a is of silver, sections 4b may be of copper and have a cross-section that exceeds the cross-section of section 4a.

Bronze is generally understood to be a binary alloy of copper and tin, but ternary alloys, or quarternary alloys, may also be used for making the heat-dam-strip sections 4b. The table below is indicative of the wide range of thermal conductivity that may be obtained with various copper alloys.

Thermal Conducting of Copper Alloys

| ASTM alloy (Spec. B 105–55) | Thermal Conductivity (volumetric) at 20° C. Btu per sq. ft. per ft per hr per deg. F. | Cal per $cm^2$ per cm per sec per deg C. |
|---|---|---|
| 8.5 | 31 | 0.13 |
| 15 | 50 | 0.21 |
| 30 | 84 | 0.35 |
| 55 | 135 | 0.56 |
| 80 | 199 | 0.82 |
| 85 | 208 | 0.86 |

The choice of metal of heat-dam-strip sections 4b depends also on specific heat since the more heat can be absorbed by heat-dam-strip sections 4b, the larger the time-lag of the particular fuse.

The preferred conductive bonds between perforated center section 4a and heat-dam-strip sections 4b are welds. There are some problems in resistance welding of two metals, such as silver and copper, having both a low specific resistance, but the welding art knows to cope with these problems and the heat-dam-strip sections 4b do not necessarily have to be made of a low electrical resistance material as copper, but may be made of a high resistance material as, e.g. bronze. If it is desired to make heat-dam-strip sections 4b of copper it may be necessary, or desirable, to percussion weld the same to perforated center section 4a.

Figure 9:
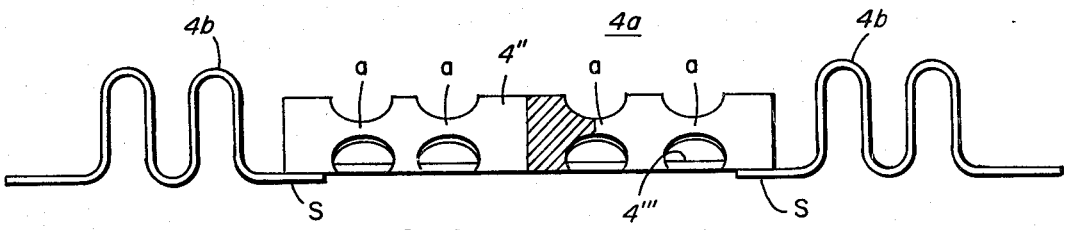
FIG. 9 is an elevational view of a portion of a fusible element embodying this invention.
Figure 10:
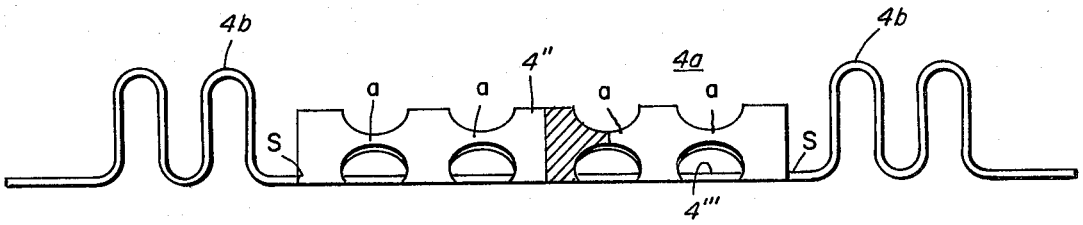
FIG. 10 is an elevational view of still another embodiment of a fusible element according to this invention.

Referring now to FIGS. 9 and 10, numerals 4a have been applied to indicate the perforated channel-shaped center section of a fusible element 4, and numerals 4b have been applied to indicate one of the heat-dam-strip sections 4b. According to FIG. 9 the latter overlap the outer surface of web portion 4''' of center section 4a and are welded to it, and according to FIG. 10 the latter do not overlap the web portion 4''' of perforated center section 4a and are welded to it in abutting relation.

When manufacturing fusible elements according to the present invention a pair of strips of a sheet metal having a smaller electrical conductivity than silver is folded transversely, preferably by an appropriate tool, and thus heat-dam-strip sections are formed separate from perforated silver section 4a. Thereafter sections 4b are conductively connected to each of the ends of silver or center section 4a. The latter may be planar while the bonding operation is being performed, and folded in a direction longitudinally thereof after the bonding operation has been completed. As an alternative the folding operation of the perforated center section may precede the operation of bonding together sections 4a and 4b, but sections 4b must be folded prior to bonding thereof to perforated center section 4a. The preferred way of bonding sections 4a to sections 4b is to arrange these sections in overlapping relation before bonding, or spot welding, the same together.

In instances where it is desired to minimize the fusing $i^2 \cdot t$ of the points a of reduced cross-section, the points of reduced cross-section of center portion 4a must consist of silver. There are, however, instances where the points of reduced cross-section a must not have the smallest possible fusing $i^2 \cdot t$, i.e. where the metal having the next lowest fusing $i^2 \cdot t$ to silver is considered sufficient for the points a of reduced cross-section. In such instances the points of reduced cross-section a of the perforated center portion 4a may be made of copper, and the pair of heat-dam-strips of a metal having a higher fusing $i^2 \cdot t$ than copper, e.g. brass.

Nor is welding the only feasible method of bonding sections 4b to section 4a. Sections 4a and 4b may, for instance, be bonded together by bonds of so-called hard solder, or silver solder.

I claim as my invention:

1. A fusible element for electric fuses comprising (a) a relatively wide center section folded in longitudinal direction, being perforated and defining a plurality of points of reduced cross-section, said points of reduced cross-section consisting of a first metal having a relatively small fusing $i^2 \cdot t$ and said points of reduced cross-section having a predetermined fusing $i^2 \cdot t$;

(b) a pair of relatively narrow heat-dam-strip sections to limit axially outward heat flow from said center section, said pair of heat-dam-strip sections being folded in transverse direction and each consisting of a second metal having a relatively large fusing $i^2 \cdot t$, said heat-dam-strip sections having a fusing $i^2 \cdot t$ larger than said predetermined fusing $i^2 \cdot t$ of said center section to prevent fusion thereof by the flow of an electric current prior to fusion of said center section; and (c) electroconductive bonds connecting the axially outer ends of said center section to one of said pair of heat-dam-strip sections.

2. A fusible element as specified in claim 1 wherein said first metal is silver and said second metal is a metal other than silver.

3. A fusible element for electric fuses as specified in claim 1 wherein said pair of heat-dam-strip sections consists of copper.

4. A fusible element for electric fuses as specified in claim 1 wherein said pair of heat-dam-strip sections consists of an alloy of copper.

5. A fusible element as specified in claim 1 wherein said center section is folded twice to assume substantially the shape of a channel having a web portion and two flange portions, and wherein said pair of heat-dam-strip sections are inserted into the space defined by said web portion and said two flange portions and are welded to said web portion.

6. A fusible element for electric fuses comprising (a) a relatively wide perforated section having at least one fold in a direction longitudinally thereof to define at least two planes enclosing a predetermined angle, said perforated section defining a plurality of points of reduced cross-section connected in parallel and having predetermined aggregate fusing $i^2 \cdot t$, said plurality of points of reduced cross-section consisting of silver;

(b) a pair of relatively narrow non-perforated heat-dam-strip sections for connecting said relatively wide perforated section into an electric circuit and limiting heat flow away from said relatively wide perforated section, said pair of heat-dam-strip sections being folded at least once in transverse direction to impart a wavy configuration to them, said pair of heat-dam-strip sections having a fusing $i^2 \cdot t$ larger than said predetermined fusing $i^2 \cdot t$ of said relatively wide perforated section to prevent fusion thereof by the flow of electric current prior to fusion of said relatively wide perforated section, and said pair of heat-dam-strip sections being of a metal having a smaller electrical conductivity than silver; and (c) a pair of electroconductive bonds each connecting an axially outer end of said relatively wide perforated section to one of said pair of heat-dam-strip sections.

7. A fusible element for electric fuses as specified in claim 6 wherein each of said pair of heat-dam-strip sections is folded a plurality of times in transverse direction.

8. A fusible element for electric fuses as specified in claim 6 wherein said electroconductive bonds are welds.

9. A fusible element for electric fuses as specified in claim 6 wherein said heat-dam-strip sections have a cross-section that exceeds the cross-section of said perforated section.

10. A fusible element as specified in claim 6 wherein said perforated section is folded twice in opposite directions so as to form a channel having a web portion and two flange portions and wherein said heat-dam-strip sections are electroconductively bonded to said web portion.

11. A fusible element as specified in claim 10 wherein said heat-dam-strip sections are inserted into said channel defined by said perforated portion and spot-welded to said web portion.

12. An electric fuse comprising a tubular casing, terminal elements closing the ends of said casing, a pulverulent arc-quenching filler inside said casing, a fusible element embedded in said pulverulent arc-quenching filler and conductively interconnecting said terminal elements, said fusible element including a relatively wide center section folded at least once in a direction longitudinally thereof to define at least two planes enclosing a predetermined angle, said center section defining a plurality of points of reduced cross-section having a predetermined fusing $i^2 \cdot t$ and consisting substantially of silver; a pair of relatively narrow heat-dam-strip sections for limiting heat flow from said center section to said terminal elements, said heat-dam-strip sections having a fusing $i^2 \cdot t$ larger than said predetermined fusing $i^2 \cdot t$ of said center section to cause initial fusion of said center section by the flow of electric currents, said heat-dam-strip sections being folded in transverse direction to limit the axial extent of the length thereof and said heat-dam-strip sections consisting of a metal having a smaller conductivity than silver; and electroconductive bonds connecting the axially inner ends of said heat-dam-strip sections to the axially outer ends of said center section and connecting the axially outer ends of said heat-dam-strip sections to said terminal elements.

13. An electric fuse as specified in claim 12 wherein said center section is folded twice in opposite directions so as to be substantially channel-shaped having a web portion and a pair of flange portions, and wherein said heat-dam-strip sections are inserted into the space defined by said web portion and said pair of flange portion, overlap said web portions and are welded to said web portion.

* * * * *